US006994098B2

(12) United States Patent
Rosenbauer et al.

(10) Patent No.: US 6,994,098 B2
(45) Date of Patent: Feb. 7, 2006

(54) METHOD FOR OPERATING A DISH WASHING MACHINE, AND A CORRESPONDING DISH WASHING MACHINE

(75) Inventors: Michael Rosenbauer, Reimlingen (DE); Bernd Schessl, Dillingen (DE); Helmut Jerg, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 161 days.

(21) Appl. No.: 10/459,815

(22) Filed: Jun. 12, 2003

(65) Prior Publication Data

US 2004/0050403 A1 Mar. 18, 2004

(30) Foreign Application Priority Data

Dec. 21, 2000 (DE) ..... 100 64 120

(51) Int. Cl.
*B08B 3/03* (2006.01)

(52) U.S. Cl. ..... 134/25.2; 134/18; 134/57 D

(58) Field of Classification Search ..... 134/18, 134/25.2, 57 R, 56 R, 57 D
See application file for complete search history.

(56) References Cited

U.S. PATENT DOCUMENTS 3,719,323 A * 3/1973 Raiser ..... 239/264
3,888,269 A * 6/1975 Bashark ..... 134/57 D
4,094,702 A 6/1978 Rabuffetti
5,151,884 A * 9/1992 Griffith et al. ..... 368/10

FOREIGN PATENT DOCUMENTS

| | | |
|---|---|---|
| DE | 4244365 | 7/1993 |
| DE | 4404369 | 8/1995 |
| DE | 19732856 | 2/1999 |
| DE | 19736919 | 3/1999 |
| FR | 2224985 | 10/1974 |
| JP | 10165913 | 6/1998 |
| WO | WO93/12706 A1 | 7/1993 |

* cited by examiner

*Primary Examiner*—Michael Barr
*Assistant Examiner*—Saeed Chaudhry
(74) *Attorney, Agent, or Firm*—John T. Winburn; Russell W. Warnock; Craig J. Loest

(57) ABSTRACT

The invention relates to a method for operating a dish washing machine (1) comprising, inside a washing tub (3), at least one spraying device (6), to which a pump (8) supplies washing liquid and which is provided with spraying openings (5). The washing liquid is sprayed into the washing tub (3) via said spraying openings (5). The aim of the invention is to be able to easily detect when the spraying openings (5) become clogged. To this end, the pump (8) is switched on and washing liquid can be supplied even when the washing tub (3) is accessible. In doing this, the flow rate of the washing liquid through the spraying openings (5), however, is simultaneously reduced to such an extent as to prevent washing liquid from spraying out of the open washing tub (3) and into the free surrounding area.

7 Claims, 1 Drawing Sheet

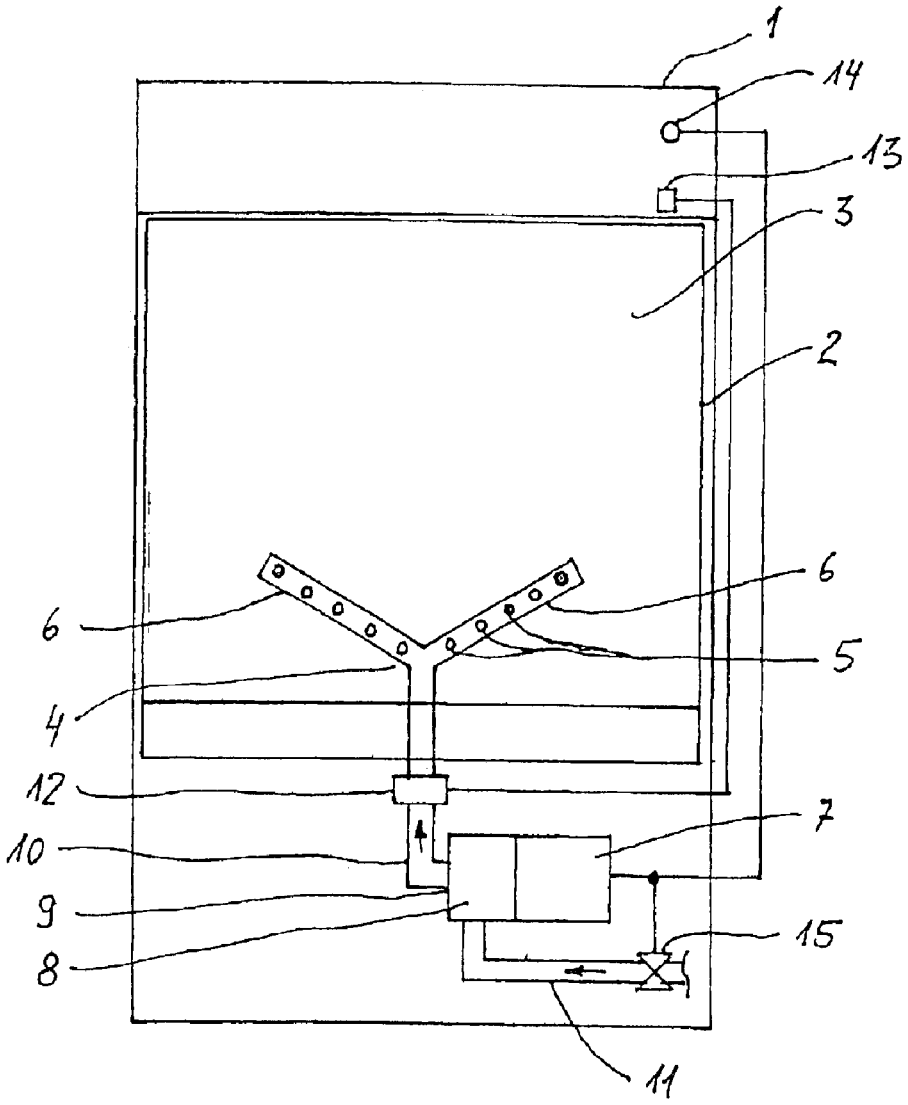
1
14
13
3
2
6
6
5
4
12
7
10
9
15
8
11

METHOD FOR OPERATING A DISH WASHING MACHINE, AND A CORRESPONDING DISH WASHING MACHINE

The invention relates to a method for operating a dish washing machine in accordance with the preamble of Claim 1.

Dish washing machines are known, in which a washing tub can be sealed tight by a door. When this door is opened during operation the liquid supply to spraying devices is interrupted as fast as possible, so that the operator and the surroundings are not sprayed with washing liquid.

WO 93/12706 A1 also discloses a dish washing machine, in which two superposed receptacles, retractable from the housing, of the same size and with tub-like wash spaces are provided in the housing of the dish washing machine. When these receptacles are withdrawn the liquid supply to spraying devices is disrupted for the above reason as fast as possible.

Dish washing machines are also known in which the goods to be washed pass through a tunnel-like washing tub by means of a conveyor, so-called through-feed dish washing machines. Also when access is made to this washing tub the liquid supply to spraying devices is interrupted for the abovementioned reason as fast as possible.

With all types of dish washing machines it occurs repeatedly that the spraying openings of the spraying device clog up partly or completely over time due to deposits, in particular lime deposits, so that insufficient or no washing liquid can pass through the spraying openings. This leads to poor cleaning results.

Such clogging of the spraying openings is not or barely recognisable for the operator of the dish washing machine, such that no assistance can be given.

The object of the invention is for the operator of a dish washing machine of any kind to easily recognise when the spraying openings become clogged.

The solution to this problem is in a method for operating a dish washing machine according to the present invention, in that also when the washing tub is accessible the pump can be switched on and washing liquid can be supplied, whereby, however, the flow rate of the washing liquid through the openings is reduced simultaneously to the extent as to prevent washing liquid from spraying out of the open washing tub and into the free surrounding area. The operator of a dish washing machine can thus observe the spraying device when the washing tub is accessible and recognise whether washing liquid is exiting from all spraying openings, or he can ascertain whether a varying quantity of washing liquid is exiting from different spraying openings. This is a sign that there is at least one instance of partial clogging of the respective spraying openings. In dish washing machines with a door this test program can be selected when the door is open, in dish washing machines with retractable receptacles with a withdrawn receptacle, in through-feed dish washing machines with accessible washing tub e.g. by partially opened, raised or tilted tunnel-like covering of the washing tub. The operator can then individually clean the affected spraying openings, again guaranteeing trouble-free flow of the washing liquid through the spraying openings. With the invention it is possible for the operator of a dish washing machine of any kind to easily recognise clogging of the spraying openings.

A simple possibility for reducing the flow rate is that depending on the open position of the washing tub the pump speed drops, so that its feed capacity is reduced to the extent that the washing liquid does not spray out into the free surrounding area. Depending on the open position of the washing tub the electric control circuit of the pump can be affected in order to decrease its feed capacity. In the process it is possible at first to shift down to a specific minimum flow rate. There is then the possibility of regulating a flow rate of the pump suitable for checking purposes by using a control member placed in the control circuit of the pump and manually adjustable, for example a potentiometer.

Reducing the flow rate can also be achieved in that depending on the open position of the washing tub at least one throttle element placed in the supply line from the pump to the spray unit and reducing the flow rate is activated. In this case the pump can be operated at normal capacity and the throttle element manages to decrease the flow rate. At the same time it can again be an advantage for the flow rate of the throttle element to be regulated.

A pressure-reduction valve can be used as throttle element. There is also the possibility of providing a diaphragm element as throttle element, whose diaphragm opening is adjusted by means of a drive, member controlled depending on the open position of the washing tub in the direction of reduced penetrability, or of using a valve controlled in the two-stroke method, whereby the two-stroke control is set in motion depending on the open position of the washing tub.

The initial task with a dish washing machine operated according to the abovedescribed method is solved in that a control element is provided, by which, when the washing tub is accessible, the pump can be switched on directly or indirectly and the supply of washing liquid can be released, in that also a sensor detecting the open position of the washing tub is present, via which throttling of the flow rate of washing liquid through the spraying openings is triggered when the washing tub is accessible. The control element can be used to activate a test program, by which the pump is also switched on and the supply of washing liquid is released when the washing tub is accessible. At the same time the flow rate at the spraying openings is reduced by the sensor detecting the open position of the washing tub. In this way it is possible to supervise the penetrability of the spraying openings without the risk of the washing liquid escaping from the washing tub.

The sensor can be switched on depending on actuating the control element activating the test program.

It is effective if, via a control signal of the sensor, the electric control circuit of the pump is influenced in the sense of a decrease in the flow capacity of the pump. Via its electric control circuit the pump can gear down its speed and thus its flow capacity to the extent that no washing liquid sprays out of the washing tub.

Another possibility for reducing the flow rate is that arranged in the supply line from the pump to the spraying device is a throttle element which can be regulated in its flow rate by a control signal of the sensor.

Advantageously, a pressure-reduction valve or a diaphragm element can be provided as throttle element, whose diaphragm opening can be adjusted by a control signal of the sensor in terms of decreasing the flow rate. If such throttle elements are used, then the pump can also be operated during checking of the penetrability of the spraying openings at its normal capacity.

By way of an embodiment illustrated in the diagram in schematic form the invention will be explained hereinbelow in greater detail.

A dish washing machine is referenced by 1, and has in the illustrated embodiment a retractable receptacle 2 with a trough-like washing tub 3. Arranged in the washing tub 3 is a spraying device 4 which has spray arms 6 fitted with spraying openings 5. In the illustrated embodiment the spray arms 6 are arranged pivotably. Via a pump 8 incorporated under the receptacle 2, and driven by an electromotor 7, washing liquid is supplied to the spray arms 6 via a supply line pipe 10 connected to the pump outlet 9. The washing liquid then exits the spraying openings 5 and is sprayed onto the dishes to be cleaned stacked in the washing tub 3. The washing liquid is fed to the pump 8 via a supply line 11.

Arranged in the supply line pipe 10 in the illustrated embodiment is an adjustable throttle element 12. The throttle element 12 is controlled by a control signal exiting from a sensor 13 detecting the open position of the washing tub 2, in such a way that the throttle element 12 is switched to minimal flow rate by this control signal emitted by the sensor 13 only when the washing tub 2 is in the open position.

To be able to carry out checking the penetrability of the spraying openings 5 when the washing tub 3 is accessible, a control element 14, e.g. a key is provided and when this is actuated both the electromotor 7 is switched on and also a valve 15 arranged in the supply line 11 can be released. In this way also when the washing tub 3 is accessible, namely with the receptacle 2 withdrawn, the washing liquid can be supplied.

When the control element 14 is actuated the feed of washing liquid can begin. If at the same time the receptacle 2 is then withdrawn and the washing tub 3 also is accessible, the flow rate of washing liquid through the spraying openings 5 is then reduced by the sensor 13 to the extent that there is no strong stream at the spraying openings 5, which might exit from the washing tub 3. The operator of the dish washing machine can therefore, without the risk of being sprayed, observe the individual spraying openings 5 and check their unhindered penetrability when the washing tub 3 is accessible. In the event of deficient penetrability the affected spraying openings 5 can then be cleaned individually.

In a dish washing machine, in which a washing tub can be sealed tight by a door, when the test program is selected by the operator and simultaneously when the door is open the flow rate of washing liquid through the spraying openings is reduced to the extent that there is no strong stream at the spraying openings, which might escape from the wash tub through the open doorway, so that the individual spraying openings can be observed and cleaned individually as required. In a through-feed dish washing machine, in which the washing tub lies under a tunnel-like cover, the test program is selected by the operator when the washing tub is accessible e.g. with the tunnel-like covering of the washing tub partly open, raised or tilted the flow rate of washing liquid through the spraying openings is reduced to the extent that there is no strong stream at the spraying openings, which might escape from the washing tub 1 so that the individual spraying openings can be observed and cleaned individually if required.

The invention makes it possible for the operator of dish washing machines of any kind to easily recognise when the spraying openings become clogged.

What is claimed is:

1. A method for operating a dish washing machine, the machine including a washing tub with a spraying device in the tub fitted with spraying openings supplied with washing liquid from a pump coupled thereto for spraying the washing liquid into the tub, comprising:

accessing said washing tub by opening a cover or door to an open position;

supplying said washing liquid to said spraying openings when accessing said washing tub by switching on said pump; and reducing the flow rate of said washing liquid through said spraying openings such that said washing liquid is prevented, from spraying out of the open washing tub into the surrounding area.

2. The method according to claim 1, including reducing said flow rate of said washing liquid through said spraying openings by reducing the speed of operation of said pump.

3. The method according to claim 1, including reducing said flow rate of said washing liquid through said spraying openings by positioning a throttle element in a supply line from said pump to said spraying openings and activating said throttle element to reduce said flow rate.

4. The method according to claim 3, including regulating said throttle element to control said flow rate.

5. The method according to claim 3, including providing and using a pressure-reduction valve for said throttle element.

6. The method according to claim 3, including providing and using a diaphragm element for said throttle element and adjusting the diaphragm opening of said diaphragm element using a drive member controlled by accessing said washing tub.

7. The method according to claim 3, including providing and using a two-stroke valve element for said throttle element and controlling said two-stroke valve element independently of accessing said washing tub.

* * * * *

UNITED STATES PATENT AND TRADEMARK OFFICE

CERTIFICATE OF CORRECTION

PATENT NO. : 6,994,098 B2
APPLICATION NO. : 10/459815
DATED : February 7, 2006
INVENTOR(S) : Michael Rosenbauer et al.

It is certified that error appears in the above-identified patent and that said Letters Patent is hereby corrected as shown below:

On the Title Page, after Item (22) insert (63) Related Application Data:
Continuation of Application No. PCT/EP01/13846, filed on Nov. 27, 2001.

Signed and Sealed this

Twenty-first Day of August, 2007

JON W. DUDAS
*Director of the United States Patent and Trademark Office*